US006307513B1

(12) United States Patent
Gaucher et al.

(10) Patent No.: US 6,307,513 B1
(45) Date of Patent: Oct. 23, 2001

(54) MICROWAVE CONNECTOR

(75) Inventors: Brian P. Gaucher, New Milford, CT (US); Modest M. Oprysko, Carmel, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/551,352

(22) Filed: Apr. 18, 2000

Related U.S. Application Data

(60) Provisional application No. 60/164,797, filed on Nov. 10, 1999.

(51) Int. Cl.[7] ..... H01Q 1/24
(52) U.S. Cl. ..... 343/702; 343/906
(58) Field of Search ..... 343/702, 906; 455/90; 439/98

(56) References Cited

U.S. PATENT DOCUMENTS

| | | | | |
|---|---|---|---|---|
| 5,828,343 | * | 10/1998 | MacDonald, Jr. et al. | 343/702 |
| 5,929,815 | * | 7/1999 | Elderfield | 343/702 |
| 5,971,813 | * | 10/1999 | Kunz et al. | 439/676 |
| 6,081,242 | * | 6/2000 | Wingo | 343/860 |

* cited by examiner

*Primary Examiner*—Don Wong
*Assistant Examiner*—James Clinger
(74) *Attorney, Agent, or Firm*—Paul J. Otterstedt, Esq.; McGinn & Gibb, PLLC

(57) ABSTRACT

A connector for a portable device, includes a jack portion integral to the portable device, and a plug portion attached to an input/output device for being inserted into the jack portion. The connector is preferably a low cost microwave connector for transmitting multiple signal types and provides dual functionability.

40 Claims, 5 Drawing Sheets

MICROWAVE CONNECTOR

CROSS-REFERENCE TO RELATED APPLICATION

The present application is related to U.S. Provisional Patent Application No. 60/164,797, filed on Nov. 10, 1999, and incorporated herein by reference.

BACKGROUND OF THE INVENTION

1. Field of the Invention

The present invention generally relates to an Input/Output (I/O) connector in electronic systems, and more particularly to a microwave connector for I/O in portable electronic systems.

2. Description of the Related Art

The number of I/O port connectors on portable electronic systems (e.g. laptop computers) keeps increasing and new methods and techniques are required to minimize the number of connectors. For example, a new wireless (e.g., radio communications) technology is being added to portable systems that has a plurality of different frequency bands for a plurality of different applications.

In the near term (e.g., over the next 5–10 years), this technology will evolve and become more widespread. However, a problem will arise in that such technology will lead to physical changes in laptops, thereby creating huge legacy support problems. For example, these problems will include how to insert a radio at a frequency that has yet to be determined, how to have a good antenna external to the system providing optimum performance, how to ensure that the antenna is replaceable in cases where it is broken, and how to manage changes in frequency band.

A further problem with connectors, and particularly, microwave connectors called SMA (an industry standard acronym) connectors used for microwave systems, is that they are made of solid metal (e.g., gold-plated or stainless steel), have highly precise instrumentation, and are designed to carry frequencies from DC to about 18 GHz. As a result, such connectors have high costs typically in a range of $2 to $30 each. This high cost drives up the cost of the systems associated with such connectors.

Additionally, it is noted that device connectors for CB radios and commercial components for televisions have a frequency of up to 800–900 MHz and such devices have not operated in the microwave regime and as such TNC, BNC and F-type connectors associated with this band are also very expensive and/or not practical technically to operate much above 1 GHz.

Further, currently wireless local area network (LANs) systems are becoming popular which use a frequency band around 2.4 GHz, but there are currently no connectors used therewith having a low cost.

Finally, antenna systems are being studied for generic interfacing with a portable devices such as laptops and personal data assistants (PDAs). However, these devices have limited surface area and thus limited I/O ports ("spigots") for interfacing with an antenna. Thus, a problem has been how to connect such antenna systems to a laptop computer so as to provide wireless connectivity for the laptop which has low cost without adding additional connectors.

SUMMARY OF THE INVENTION

In view of the foregoing and other problems, disadvantages and drawbacks of the conventional connectors, an object of the present invention is to provide a structure that solves these problems by adding a new I/O device without increasing the number of connectors.

It is another object of the invention to use a low cost plastic microwave connector as an antenna connector in a portable computer.

Yet another object is to use an existing standard connector to provide an additional I/O device without having to physically alter the structure of a portable computer.

In a first aspect of the present invention, an antenna connector for a portable device, includes a jack portion integrally formed with the portable device, and a plug portion attached to an antenna subsystem.

In a second aspect of the present invention, a portable device includes a housing, a plastic microwave connector, within the housing, functioning as an antenna connector in the portable device, the connector having an insertion loss of <0.5 dB and a return loss >10 dB, a phone connector having a plurality of spring-loaded contacts, wherein a jack portion of the phone connector is built into the housing of the portable computing device, and wherein a plug portion of the phone connector is for locating an antenna subsystem, thereby allowing a removable antenna to be selectively replaced.

In a third aspect of the invention, the connector may form the basis of a subsystem, that comprises not only the desired connector function, but also provide additional functionality such as a physical switch that allows multi-purpose operation (e.g., V.90 modem functionality if a normal RJ11 connector is plugged into the jack or wireless connectivity if an antenna connector, slightly different in shape, is plugged into the jack). The jack portion may house additional circuitry such as a switch (e.g., electrical or physical), that may route signals from one set of pins to another inside a laptop or other device. In one embodiment of the switch, a PC board can be envisioned that is physically moved side-to-side by the insertion force of a special antenna version of the RJ11 connector. The action of moving the PC board places the traces under one of two sets of contacts, thereby enabling more than one set of signals to pass through the connector based upon what is physically present in the jack. Other functionality that may now be provided might include an LNA (Low Noise Amplifier), a diversity switch for multiple antennas on the connector, LEDs (Light Emitting Diodes) for user indicators, etc.

Thus, in an exemplary embodiment, a simple RJ11/RJ45 (e.g., telephone jack) type of connector is provided which has been modified by the invention to handle radio frequency (RF) communications. Further, a removable antenna can be interfaced (connected) to the connector which can handle a wireless LAN at 2.4 GHz, a cellular telephone at 900 MHz, a cellular telephone at 1.9 GHz, or high-speed wireless connectivity at 5 GHZ. Hence, the generic interface if provided in a portable device can have low cost as well as be upgradable.

With the unique and unobvious structure of the present invention, a new I/O device is provided without increasing the number of connectors. Further, the connectors are preferably provided as a low-cost plastic microwave connector for functioning as an antenna connector in a portable device (e.g., a computer, PDA, etc.). Finally, with the connector of the present invention, an existing standard connector can be used to provide an additional I/O device without having to physically alter the structure of a portable device (e.g., computer).

Another advantage is that such a new connector may provide multi-functionality. The ability to switch from one communications medium to another through this connector opens new paradigms for connectivity without significantly increasing cost.

The ability to change frequency bands as technology progresses is a very attractive feature. Companies will have a reduced legacy issue with their machines. For example, one can see that PC manufacturers have several different interface slots now available including PCMCIA and MiniPCI bay. Neither of these interface slots has the ability to interface an antenna through the PC connector. However, the present invention provides such a capability. Vendors can now select the desired slot and function for wireless communications and add the antenna later.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF PREFERRED EMBODIMENTS OF THE INVENTION

Referring to the Figures, and more particularly to FIGS. 1–10, there are shown preferred embodiments of an I/O connector according to the present invention.

Figure 1:
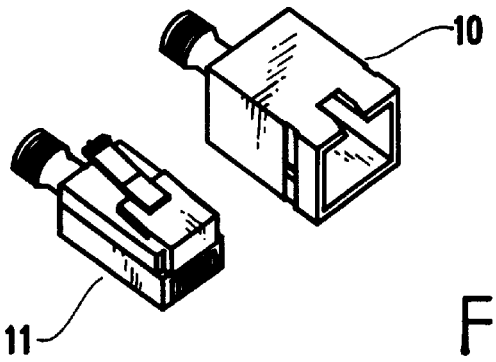
FIG. 1 illustrates a gold SMA connector 11 for being attached to a standard plastic RJ11 connector 11, with both the male and female portions being shown.

Referring to FIG. 1, a low cost microwave connector 10 used as an antenna connector is shown, as well as a gold SMA connector 11. In order to determine suitability of these microwave connectors as antenna connectors, measurements must be taken of insertion loss and return loss vs. frequency.

As known, insertion loss is a measure of the amount of energy dissipated as heat and thus never reaching its intended target. Return loss is the amount of transmitted energy that is reflected back to a source because of poor impedance matching. Results indicative of high performance for microwave connectors are <0.5 dB insertion loss and >10.0 dB return loss.

Figure 2:
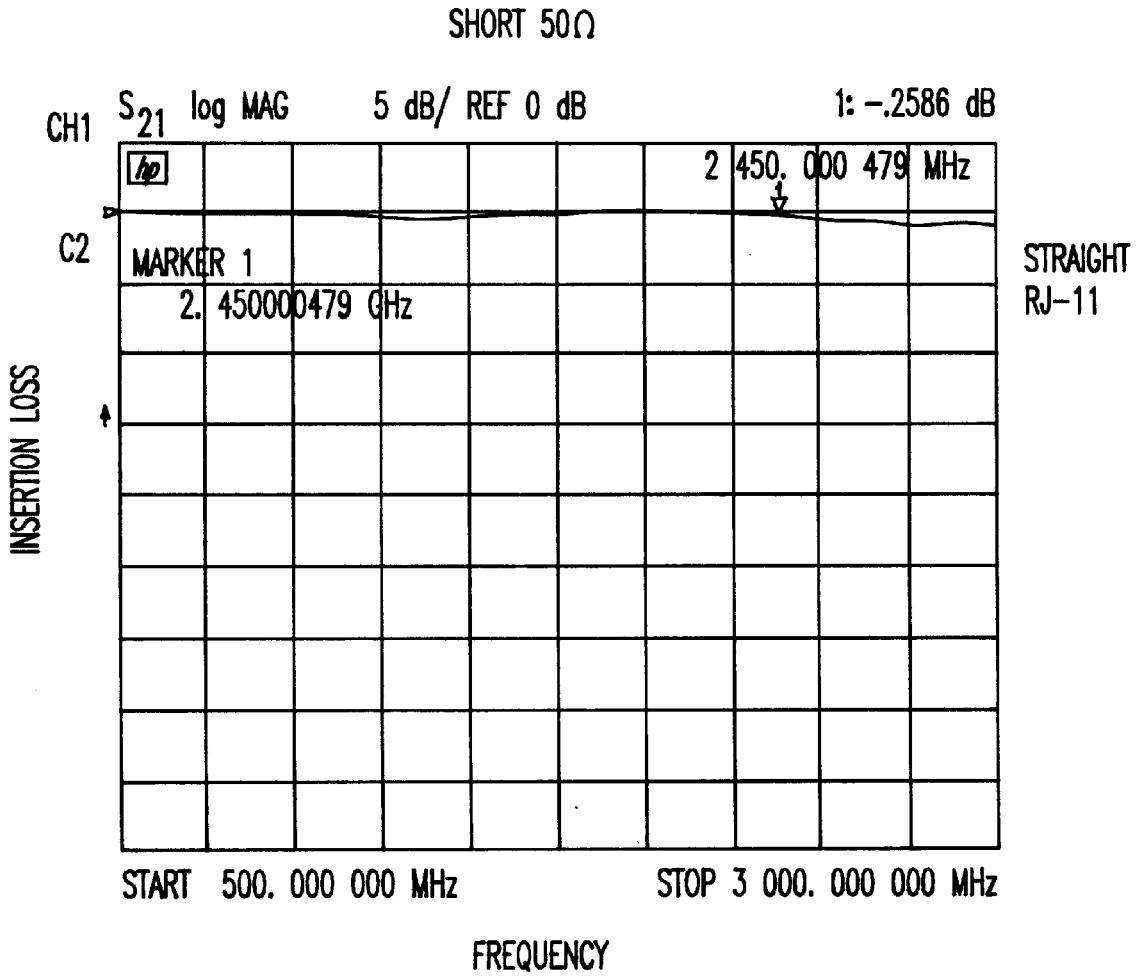
FIG. 2 illustrates measurements of insertion loss vs. frequency when the portions in FIG. 1 are connected.
Figure 3:
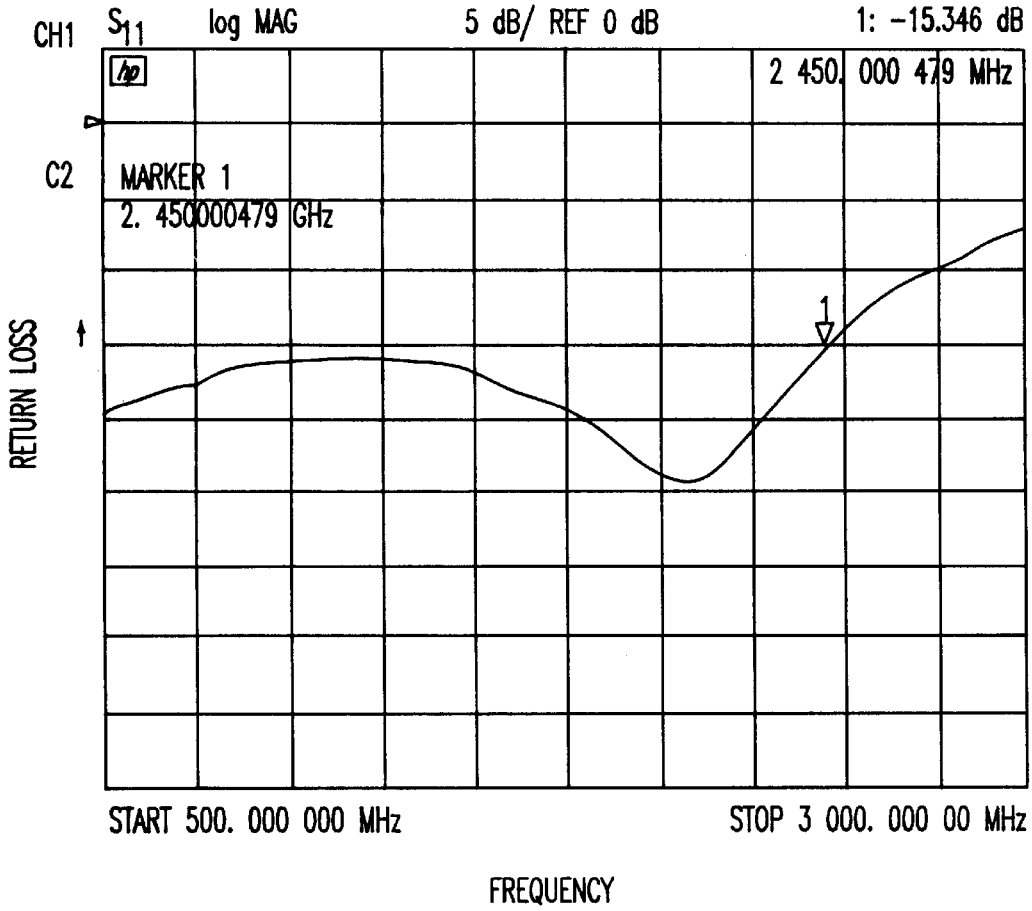
FIG. 3 illustrates measurements of return loss vs. frequency when the portions 10, 11 in FIG. 1 are connected.

Virtually all microwave test equipment and RF devices use high-cost precision connectors 11, from a group including either SMA, APC-3.5, and APC-7 (e.g., standard, commercially-available microwave connectors). Plastic microwave connectors 10 are required to mate to these for test and comparison purposes. When mated together and tested, a good result will be an insertion loss of <0.5 dB and a return loss >10 dB, as illustrated in FIGS. 2 and 3.

Thus, the use of plastic connectors 10 for microwaves is understood and the invention applies the plastic connectors to other issues/problems, such as the above-described antenna problem. The invention solves the antenna problem by using an existing standard RJ11 or RJ45 phone connector, that has a plurality (e.g., four to six) spring-loaded contacts. This could also be a speaker connector, RS232 connector etc., such as would be on a personal computer (PC) (laptop, etc.).

The jack portion of the phone connector is built into the laptop computer, whereas the plug portion is where an antenna subsystem may be located. This combination allows a pluggable or removable antenna to be selectively replaced if broken, changed if the radio frequency is altered, or made multi-mode to cover several frequency bands of operation.

In addition, since most PCs or electronic boxes have some form of electromagnetic induction/electromagnetic capacitance (EMI/EMC) shielding in them, providing an external antenna creates another level of freedom and enhanced performance. If the antenna were located within the electronic enclosure, the radio signals would be severely attenuated. In this case, the signals are routed to the outside and then radiated freely into the area. Though this could be applied to almost any radio band, the most obvious application is at 900 MHZ for cellular telephones and cordless phones, at 1.8 GHZ for the new personal communication services (PCS) phones, and 2.4 GHZ and 5 GHZ for wireless local area networks (LANs).

Figure 4:
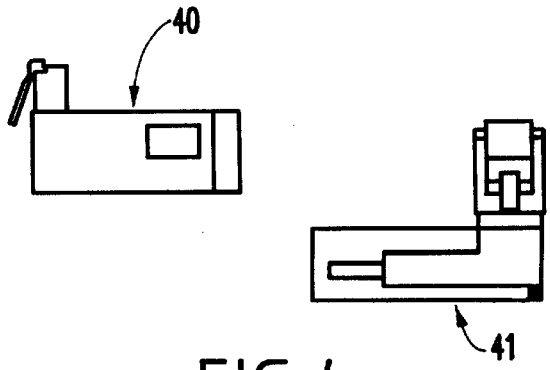
FIG. 4 is a ceramic antenna according to a preferred embodiment of the present invention.
Figure 5:
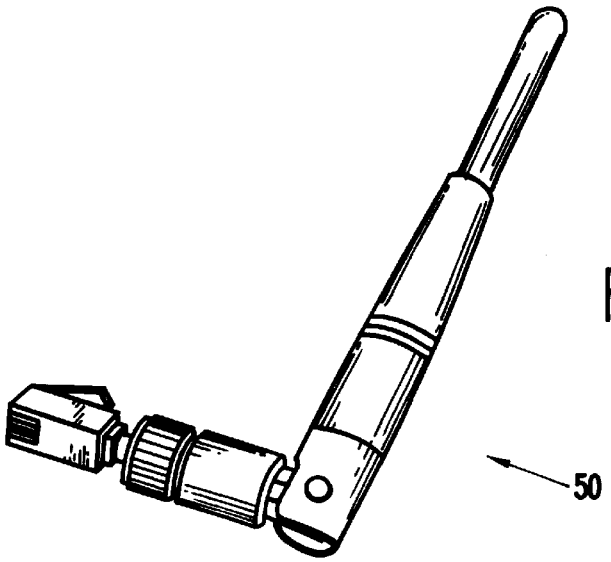
FIG. 5 is a deployable antenna capable of vertical rotation to enhance range performance.
Figure 6:
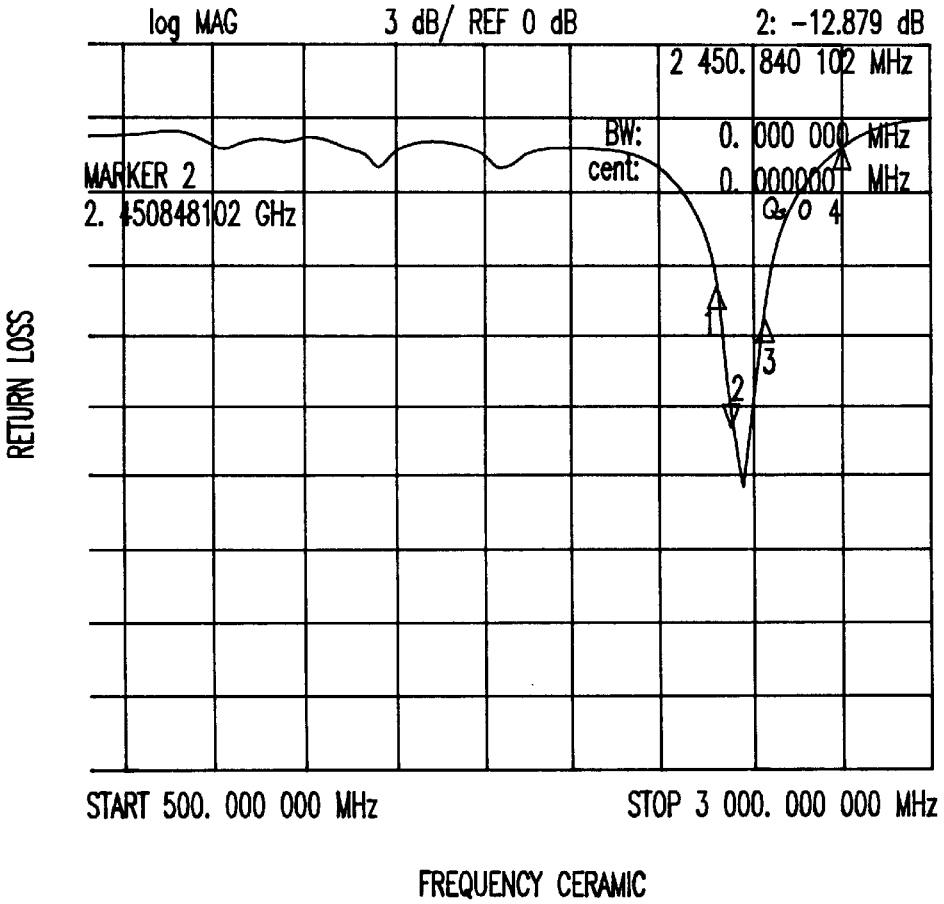
FIG. 6 illustrates the measured return loss vs. frequency for the antenna of FIG. 4 (e.g., greater than 10 dB)
Figure 7:
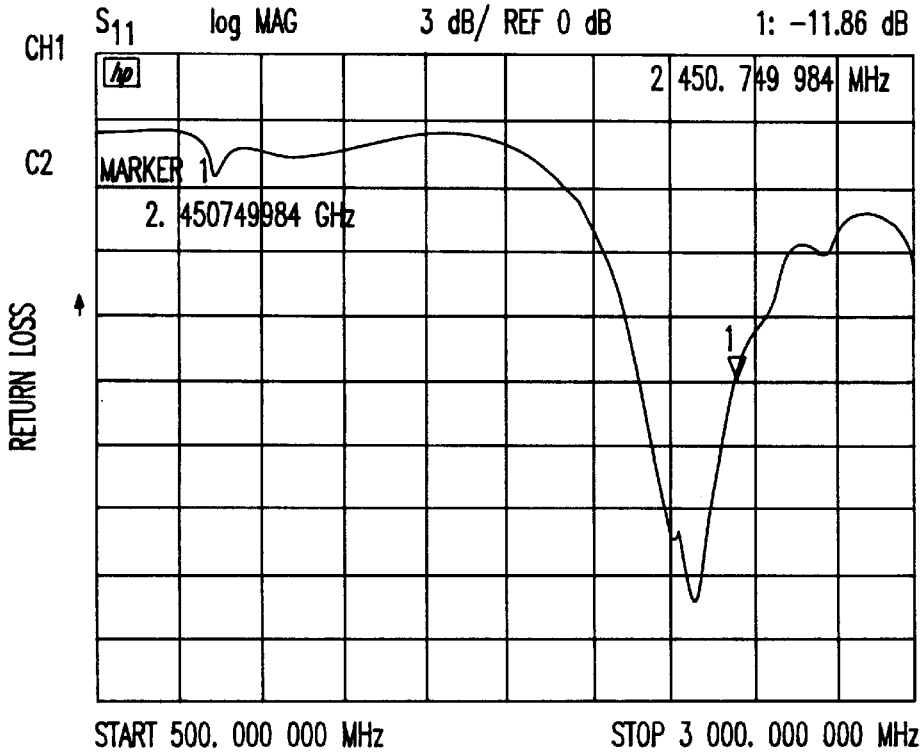
FIG. 7 illustrates the measured return loss vs. frequency for the antenna of FIG. 5 (e.g., greater than 10 dB)

FIGS. 4 and 5 highlight two exemplary versions of antennas, 40, 41 and 50 including the microwave connectors according to the invention. The antenna of FIG. 4 is very flat and when mounted remains flush with a mounting surface. The antenna of FIG. 5 is a deployable antenna, which can be rotated vertically to enhance range performance. It is again noted that the RJ11 connector is the device that can make use of these standard style antennas allowing all the benefits of low cost implementation.

The actual antenna type selected is not important, provided it is carefully matched to the system and application. Thus, the antenna can be a ceramic antenna, a PC board antenna, a telescoping swivel antenna, an F-type antenna, an inverted F-type microstrip patch, a quarter-wave antenna, a half-wave antenna, or the like.

The signals to and from the existing RJ11 or RJ45 phone connector are shared or mixed together, allowing for both a radio frequency (RF) function and a V.90 or Ethernet function. As such, a new electrical I/O is added without a physical connector. In addition, the output lines of the RJ11 or RJ45 can be shared to provide signals to, for example, light emitting diodes (LEDs), low noise amplifiers (LNAs), switches, etc.

The performance characteristics of these antennas can be measured in two distinct ways. First, performance can be gauged by measuring return loss, with a criteria of >10.0 dB. Secondly, performance can be gauged by measuring gain. It is noted that generally gain is difficult to measure because it is directly related to the surrounding environment and, because it is not directly related to the connector implementation, it will not be further described herein.

The object in using these connectors is to leverage the existing physical structure in the device and provide an antenna connector that mates to the device. Internally, within the laptop, the wires are multiplexed to include the new radio function.

Figure 8A:
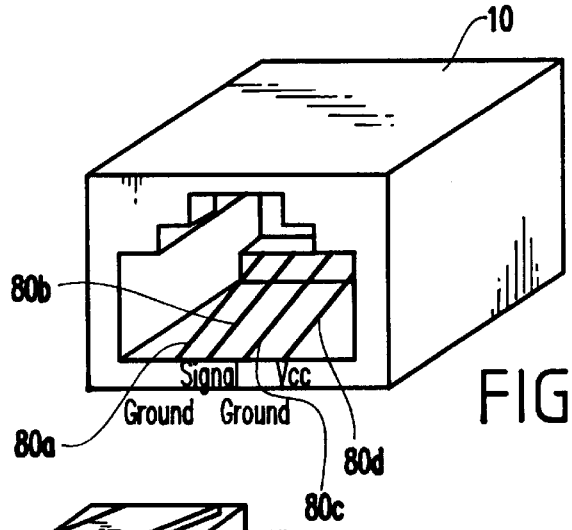
FIG. 8A shows the creation of a transmission line by using three of the phone connector's wires.
Figure 8B:
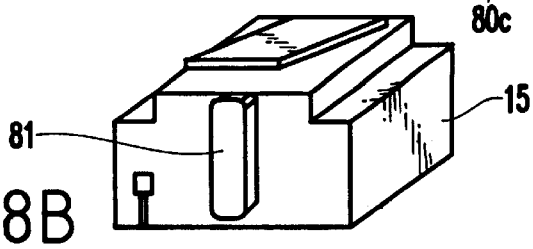
FIG. 8B illustrates an antenna for being inserted into the connector 10 of FIG. 8A.

As shown in FIG. 8A, the phone connector 10 has a plurality (e.g., four to six) wires 80*a*–80*d* (e.g., ground wire, signal wire, ground wire, and Vcc wire shown in FIG. 8A), of which three can be used to create a transmission line. The antenna 81, as shown in FIG. 8B, can be directly embedded into the connector 10, provided a sufficient ground is available.

Furthermore, the replaceable antenna can be a subsystem itself. An issue in routing high frequency radio signals is insertion loss. If insertion loss is minimized, then battery life can be saved, thereby extending range or operating distance, and enhancing the reliability of communication links.

The fourth connection 80*d* (e.g., designated as Vcc), inside the connector 10, can be advantageously used to provide DC voltage to provide power to a light emitting device (LED), a low noise amplifier (LNA), a power amplifier (PA), a switch, etc. Making use of these elements, integrally built inside a module in the embodiment, achieves longer battery life, increased range, and improved reliability.

Figure 9A:
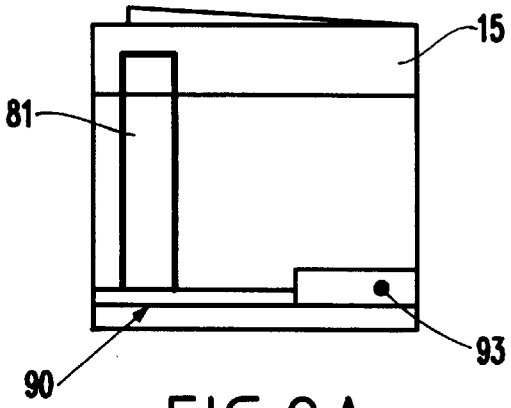
FIG. 9A shows a side view of an antenna subsystem, including a personal computer (PC)
Figure 9B:
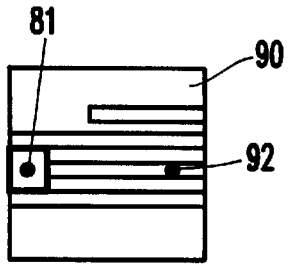
FIG. 9B illustrates a top view of the antenna subsystem of FIG. 9A.

FIG. 9A and 9B illustrate (in a side view and a top view, respectively) that a PC board 90 can be mounted inside the jack portion 15 of connector 10 in an exemplary implementation of the present invention. The PC board 90 may contain a matching network, and the active and passive electronic elements, including antennas 81. A key feature of this implementation is that the transmission lines 92 on the board 90 are created as microstrip, stripline, or coplanar waveguides to minimize impedance variations. Contacts 93 are also shown in FIG. 9A.

The present invention advantageously uses the design of the conventional RJ11 and RJ45 plastic connectors which have parallel wires internal to their construction. These wires can be used as RF transmission structures similar to a coplanar waveguide or slab line whose characteristic impedance is between 50 to 100 ohms.

Thus, as described above, an exemplary embodiment of the invention includes modifying both an RJ11 jack and plug connectors to accommodate RF interfaces for measuring characteristic impedance, insertion loss, bandwidth and reliability, and using it as an RF transmission media.

Figure 10:
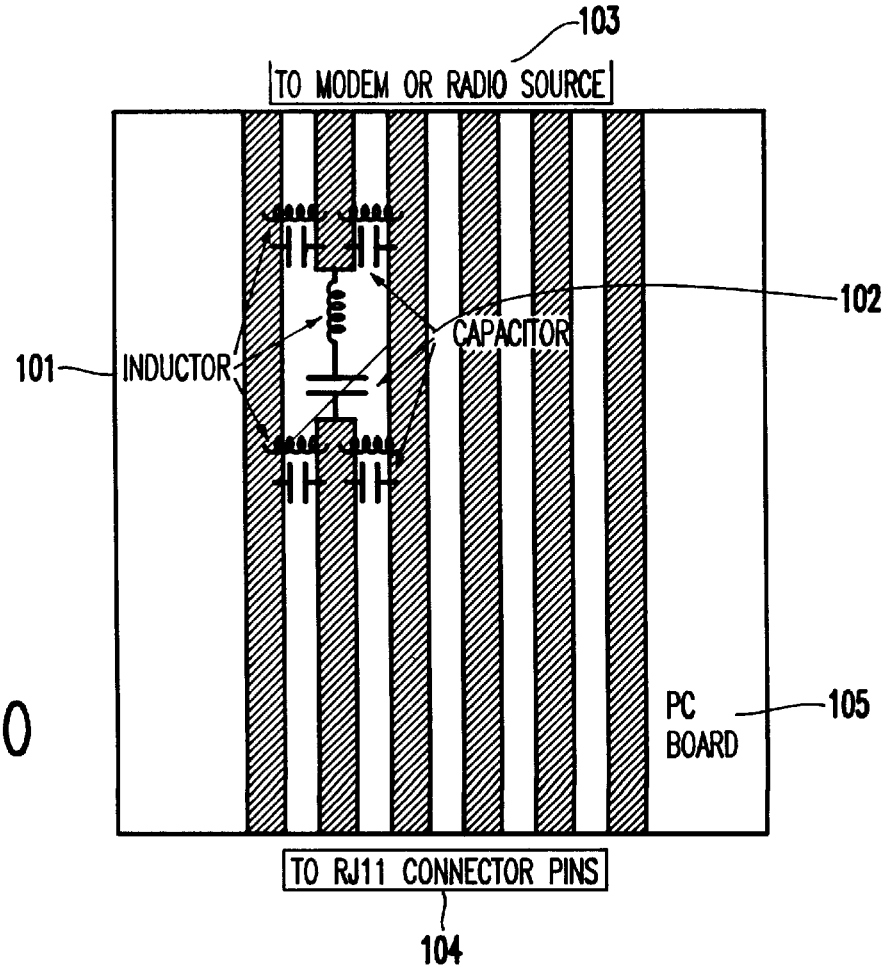
FIG. 10 illustrates another exemplary embodiment of the present invention which uses a connector to create a matching network.

As further described above, a second exemplary embodiment uses a connector to create a matching network taking the characteristic impedance of the plug/jack combination and matching it to either higher or lower characteristic impedance values or a more conventional 50-ohm termination. That is, a matching network is shown in FIG. 10, and includes inductors 101 and capacitors 102 to represent elements that can only be determined for a specific implementation. Further, inputs/outputs 103, 104 to a modem/radio source and to RJ11 connector pins are also shown. Additionally, a PC Board 105 is shown. In general, the network represents a filter that both matches the impedance and helps contain the RF energy within a specific band. This should be created for the antenna to ensure that the antenna passes the high frequency signals without degrading them. This matching network can be made very general to apply to a broad range of frequencies or can be designed to be narrow band to help supplement filtering required to meet FCC regulations. Along with other switch functions, it forms part of the subsystem of a communication system. This matching network and a unique transmission line structure of the invention allows using the above-mentioned low-cost connectors.

As is known, a matching network is used on a transmission line. That is, on a transmission line, a source (e.g., a "radio") outputs energy to a receiver. In a standard implementation, a 50-ohm termination (impedance) is desirable. Ideally, if a 50-ohm resistor was provided at the end of the line, then all of the energy outputted by the radio would be absorbed and the equipment would be intact and properly functioning.

However, if no termination (impedance) was provided at the end of the line and the radio was connected and operational, an open circuit would result, and all of the energy attempted to be output from the port (spigot) would be pushed back (back up) to the radio, and in a worst case the radio would potentially be destroyed. Thus, an objective is to reach the terminating impedance that the radio is operational with (e.g., wants to see), and in most cases such a terminating impedance is 50 ohms. Obviously, the terminating impedance depends on the design of the "radio".

Hence, it is again noted that the present invention may exemplary match to a conventional 50-ohm termination impedance which represents a standard impedance used in many radio applications. While the invention does not require 50 ohms, the invention preferably has the signals to and from the connector matched for maximum energy transfer. Other exemplary impedances which can be matched are 75 ohms, 100 ohms and 300 ohms. Obviously, other impedances could be equally matched.

Returning to the exemplary 50-ohm impedance value, subsequent to matching the 50-ohm termination, a miniature ceramic antenna, as in FIG. 4, can be added to the configuration. The actual antenna used is not critical, but the overall performance of the combination is important. For example, a commonly available ceramic antenna can be used, as well as a deployable sleeve dipole.

Thus, with the present invention, a new I/O device is provided without increasing the number of connectors. The connectors are preferably provided as a low-cost plastic microwave connector for functioning as an antenna connector in a portable computer. Moreover, with the inventive connector, an existing standard connector can be used to provide an additional I/O device without having to physically alter the structure of a portable computer.

While the invention has been described in terms of preferred embodiments, those skilled in the art will recognize that the invention can be practiced with modification within the spirit and scope of the appended claims.

What is claimed is:

1. An antenna connector for a portable device, comprising:

a jack portion integrally formed with said portable device; and a plug portion, attached to an antenna subsystem, for being inserted into said jack portion, wherein said jack portion allows dual functionability of said connector, said dual functionability comprising an antenna connection and at least one of a wireless local area network (LAN) connection, a cellular telephone connection, a high-speed wireless connection, a switch function, a low noise amplifier, a diversity switch for multiple antennas, and an indicator function.

2. The antenna connector, as claimed in claim 1, wherein said antenna connector comprises a microwave connector.

3. The antenna connector, as claimed in claim 1, wherein said antenna connector comprises a plastic material.

4. The antenna connector, as claimed in claim 1, wherein said jack portion comprises at least four spring-loaded contacts.

5. The antenna connector, as claimed in claim 1, wherein said antenna subsystem is located externally to said portable device.

6. The antenna connector, as claimed in claim 1, wherein said antenna subsystem transmits at a radio band of 900 MHz.

7. The antenna connector, as claimed in claim 1, wherein said antenna subsystem transmits at a radio band of 1.8 GHz.

8. The antenna connector, as claimed in claim 1, wherein said antenna subsystem transmits at a radio band of 2.4 GHz.

9. The antenna connector, as claimed in claim 1, wherein said antenna subsystem comprises one of a ceramic substrate mounted antenna, a personal computer (PC) board antenna, a telescoping swivel antenna, an F-type antenna, an inverted F-type microstrip patch, a quarter-wave antenna, and a half-wave antenna.

10. The antenna connector, as claimed in claim 1, wherein said antenna connector transmits multiple signal types.

11. The antenna connector, as claimed in claim 1, wherein said antenna connector provides a direct current (DC) voltage.

12. The antenna connector, as claimed in claim 1, further comprising:

a housing for housing said antenna subsystem; and a printed circuit board having said antenna subsystem mounted thereon, said printed circuit board comprising a matching network, and a plurality of active and passive electronic elements.

13. The antenna connector, as claimed in claim 12, wherein said printed circuit board comprises transmission lines comprising at least one of microstrip transmission lines, stripline transmission lines, and coplanar transmission lines.

14. The antenna connector, as claimed in claim 12, wherein said matching network matches impedance values of a connector to a termination.

15. The antenna connector as claimed in claim 1, further comprising at least one of an electrical switch and a physical switch for switching said antenna connector.

16. The antenna connector as claimed in claim 1, wherein said antenna connector comprises a mechanism for one of changing signal paths and adding high frequency matching networks.

17. A portable device, comprising:

a housing;

a plastic microwave connector, within said housing, functioning as an antenna connector in said portable device, said plastic microwave connector having an insertion loss of <0.5 dB and a return loss >10 dB and a plurality of contacts, a jack portion, and a plug portion, wherein said jack portion of the plastic microwave connector is built into said housing, wherein said plug portion of said plastic microwave connector is for locating an antenna subsystem thereat, thereby allowing a removable antenna to be selectively replaced, and wherein said jack portion allows dual functionability of said plastic microwave connector, said dual functionability comprising an antenna connection and at least one of a wireless local area network (LAN) connection, a cellular telephone connection, a high-speed wireless connection, a switch function, a low noise amplifier, a diversity switch for multiple antennas, and an indicator function.

18. The device according to claim 17, wherein an antenna of said antenna subsystem is flat and when mounted is flush with a mounting surface of said housing.

19. The device according to claim 17, wherein an antenna comprises a deployable antenna, for being selectively rotated.

20. The device according to claim 17, wherein said antenna comprises one of a ceramic substrate mounted antenna, a printed circuit board antenna, a telescoping swivel antenna, an F-type antenna, an inverted F-type microstrip patch, a quarter-wave antenna, and a half-wave antenna.

21. The device according to claim 17, wherein signals to and from the plastic microwave connector are shared or mixed together, allowing for both a radio frequency (RF) function and a network function.

22. The device according to claim 21, wherein said network function comprises an Ethernet network function.

23. The device according to claim 21, wherein a connection of said plastic microwave connector is for providing DC voltage to an external element of said plastic microwave connector.

24. The device according to claim 21, further comprising:

a printed circuit (PC) board mounted inside the jack portion of said plastic microwave connector, said PC board containing a matching network, and a plurality of active and passive electronic elements, including said antenna, transmission lines on the PC board being formed as one of a microstrip waveguide, a stripline waveguide, and a coplanar waveguide, to minimize impedance variations.

25. The device according to claim 21, further comprising:

a ceramic substrate mounted antenna coupled to the plastic microwave connector.

26. The device according to claim 21, wherein said plastic microwave connector includes a housing and parallel wires internal to the housing, said wires being for radio frequency (RF) transmission structures having a characteristic impedance.

27. The device according to claim 26, wherein said plastic microwave connector includes a jack connector and a plug connector to accommodate RF interfaces for measuring characteristic impedance, insertion loss, bandwidth and reliability, and using it as an RF transmission media.

28. The device according to claim 27, wherein the plastic microwave connector creates a matching network taking the characteristic impedance of a combination of the plug and jack connectors and matching the impedance to either higher or lower characteristic impedance values, or to a predetermined termination.

29. The device according to claim 17, wherein said plastic microwave connector includes a plurality of lines for being shared to provide a plurality of signals to internal components of said portable device.

30. The device according to claim 17, wherein said plastic microwave connector has a plurality of wires, a portion of said plurality of wires being used for transmission lines.

31. The device according to claim 17, wherein said antenna is directly embedded into the plastic microwave connector.

32. The device according to claim 17, wherein said antenna comprises a selectively replaceable antenna.

33. The device according to claim 17, wherein said plastic microwave connector comprises one of a microwave connector and a telephone connector.

34. The device according to claim 17, wherein said plastic microwave connector is operable as a switchable device for selectively providing a microwave connection and a telephone connection.

35. The device according to claim 17, wherein said plastic microwave connector comprises a microwave connector.

36. The antenna connector as claimed in claim 17, further comprising at least one of an electrical switch and a physical switch for switching said antenna connector.

37. The antenna connector as claimed in claim 17, wherein said antenna connector comprises a mechanism for one of changing signal paths and adding high frequency matching networks.

38. An antenna connector for a portable device, comprising:

a female portion integrally formed with said portable device; and a male portion, attached to an antenna subsystem, for being inserted into said female portion, wherein said female portion allows dual functionality of said connector, an antenna connector for a portable device, comprising:

a jack portion integrally formed with said portable device; and a plug portion, attached to an antenna subsystem, for being inserted into said jack portion, wherein said jack portion allows dual functionability of said connector, said dual functionability comprising an antenna connection and at least one of a wireless local area network (LAN) connection, a cellular telephone connection, a high-speed wireless connection, a switch function, a low noise amplifier, a diversity switch for multiple antennas, and an indicator function.

39. The antenna connector as claimed in claim 38, further comprising at least one of an electrical switch and a physical switch for switching said antenna connector.

40. The antenna connector as claimed in claim 38, wherein said antenna connector comprises a mechanism for one of changing signal paths and adding high frequency matching networks.

* * * * *